US005951499A

United States Patent [19]

Saringer et al.

[11] Patent Number: 5,951,499

[45] Date of Patent: Sep. 14, 1999

[54] CONTINUOUS PASSIVE MOTION DEVICE FOR UPPER EXTREMITY FOREARM THERAPY

[75] Inventors: John H. Saringer, Unionville; Jeffrey J. Culhane, Pickering, both of Canada

[73] Assignee: Orthologic Corp., Phoenix, Ariz.

[21] Appl. No.: 08/902,124

[22] Filed: Jul. 29, 1997

Related U.S. Application Data

[60] Provisional application No. 60/044,646, Apr. 18, 1997.

[30] Foreign Application Priority Data

Sep. 27, 1996 [GB] United Kingdom ..... 9620208

[51] Int. Cl.[6] ..... A61H 1/00

[52] U.S. Cl. ..... 601/33; 601/5

[58] Field of Search ..... 601/5, 23, 33–35, 601/40; 602/5, 16, 20, 21, 23, 26, 27, 29; 482/44, 45, 46, 94, 139; 623/57, 59; 128/881

[56] References Cited

U.S. PATENT DOCUMENTS

| | | | |
|---|---|---|---|
| 4,538,595 | 9/1985 | Hajianpour . | |
| 4,577,623 | 3/1986 | Pecheux . | |
| 4,669,451 | 6/1987 | Blauth et al. | 601/33 |
| 4,716,889 | 1/1988 | Saringer | 601/40 |
| 4,899,735 | 2/1990 | Townsend et al. . | |
| 5,067,479 | 11/1991 | Saringer et al. . | |
| 5,163,451 | 11/1992 | Grellas | 601/33 |
| 5,383,844 | 1/1995 | Munoz et al. | 602/20 |
| 5,458,560 | 10/1995 | Kaiser et al. . | |
| 5,484,394 | 1/1996 | Singer et al. | 602/16 |
| 5,503,619 | 4/1996 | Bonutti . | |
| 5,662,595 | 9/1997 | Chesher et al. | 602/20 |
| 5,759,165 | 6/1998 | Malewicz | 602/21 |

*Primary Examiner*—Jeanne M. Clark
*Attorney, Agent, or Firm*—Hill & Schumacher

[57] ABSTRACT

A continuous passive motion (CPM) device for the synovial joints and surrounding soft tissue of the human body, more specifically to the upper extremities. The device includes an upper arm support suitably fixed to a drive actuator and a adjustable forearm support attached to the rotational center of the drive actuator so that pivotal movement of the output causes the forearm support to pivot about an axis parallel to a longitudinal axis of the forearm support. Various cuffs are provided so a patient can secure their upper arm above the elbow and the upper forearm below the elbow to the device with the actuator located either forward of or behind the elbow. The rotational motion of pronation and supination is created by aligning the rotational center of the actuator output with the anatomical rotational center of the forearm. The rotational centers are concentric to minimize stresses on the affected limb. The relative rotational motion between the upper support and forearm support creates the passive anatomical motion of pronation and supination.

24 Claims, 6 Drawing Sheets

CONTINUOUS PASSIVE MOTION DEVICE FOR UPPER EXTREMITY FOREARM THERAPY

CROSS REFERENCE TO RELATED U.S. PATENT APPLICATION

This patent application relates to U.S. Provisional patent application, Ser. No. 60/044,646, filed on Apr. 18, 1997, entitled CONTINUOUS PASSIVE MOTION DEVICE FOR UPPER EXTREMITY FOREARM THERAPY.

BACKGROUND OF THE INVENTION

1. Field of the Invention

The present invention relates to continuous passive motion devices for the rehabilitative and therapeutic mobilization of human synovial joint and surrounding soft tissue, and more particularly, the invention relates to continuous passive motion devices for upper extremity forearm therapy.

2. History of the Related Art

In recent years it has become evident that the rehabilitation and treatment of injured joints and surrounding soft tissue can be expedited by use of continuous passive motion (CPM) applied to the involved joint. CPM entails moving the joint via its related limbs through a passive controlled range of motion without requiring any muscle coordination. Active motion is also beneficial to the injured joint, however, muscle fatigue limits the length of time the patient can maintain motion therefore a device that provides continuous passive motion to the joint is essential to maximize recovery. Numerous studies have proven the clinical efficacy of CPM to accelerate healing and maintain range of motion.

Furthermore, the rehabilitation of joints and soft tissue through CPM has become an important modality in the treatment of articular injuries. The need for a CPM device specific to the forearm is justified by the complications in the recovery process of distal radial fractures and fractures to the wrist. The wrist is one of the most frequently fractured bones in the human body. Present protocols for wrist fracture treatment require the wrist to be immobilized with the result that the muscles that provide the forearm with the ability to pronate and supinate contract. This effectively limits the ability of the forearm to move through its natural range of motion. The ability of the forearm to pronate and supinate is essential in maintaining a normal functional lifestyle. Without this range of motion the patient's ability to undertake routine daily activities such as turning a door knob, turning a key, eating with utensils may be severely compromised.

U.S. Pat. No. 5,503,619 issued to Bonutti discloses an orthosis device for bending of wrists in extension and flexion. This patent does not provide for pronation or supination of the wrist joint. Similarly, U.S. Pat. No. 5,067,479 issued to Saringer et al. is directed to a device for continuous passive motion of the wrist joint in flexion and extension.

U.S. Pat. No. 4,899,735 issued to Townsend et al. is directed to a torsion bar splint for pronation and supination of the wrist and forearm. This device is an active exercise device which includes a pair of telescoping rods with the a bracket pivotally attached at one end of a first rod for limited pivotal movement about the longitudinal axis of the first rod, the bracket being adapted to be secured to the palm of the hand by a plaster cast. The opposing end of the second rod engages a one-way clutch attached to a bracket adapted to be affixed to the user's upper arm thereby locking the arm in 90°. The two telescoping rods are locked together to prevent rotation with respect to each other by a locking screw and the user actively exercises the distal radioulnar joint by rotating the wrist in the direction allowed by the one-way clutch thereby pronating or supinating the wrist. The one-way clutch retains the wrist in the furthest extent of its range of motion and to release the joint to return to its relaxed position requires the user to loosen the locking screw to allow rotation of one rod with respect to the other rod. This type of device is awkward to fit into, is an active exercise device only, and requires constant readjustment by the user.

Therefore, it would be very advantageous to provide a CPM device for the forearm which provides for an adjustable range of motion during therapeutic exercise.

SUMMARY OF THE INVENTION

It is an object of the present invention to provide continuous passive motion devices for the rehabilitation of the upper extremity forearm, which provides a controlled passive and adjustable range of motion to the forearm.

The present invention provides continuous passive motion (CPM) devices for the synovial joints and surrounding soft tissue of the human body, more specifically to the upper extremities.

The invention relates to continuous passive motion (CPM) devices for the synovial joints and surrounding soft tissue of the human body, more specifically to the upper extremities. The device forming the present invention comprises an upper arm support suitably fixed to a drive actuator and an adjustable forearm support suitably fixed to the rotational center of the drive actuator. The rotational motion of pronation and supination is created by aligning the drive actuator's rotational center with the anatomical rotational center of the forearm. The rotational centers are concentric to minimize stresses on the affected limb. The relative rotational motion between the upper support and forearm support creates the passive anatomical motion of pronation and supination. The forearm and upper arm supports have a means of fixing the arm in their respective supports. In a preferred embodiment the proximal arm support fixes the elbow in substantially 90 degrees of flexion. The upper arm support maintains the elbow in flexion in the preferred embodiment to ensure the rotational motion generated is transmitted to the forearm and not dissipated at the shoulder. The distal forearm support member is comprised of two components. A proximal end is fixed to the rotational center of the drive actuator. The distal end is slidably mounted to the proximal end, adjusting in length to accommodate anthropometric variances in forearm length. The distal end portion of the forearm support also includes a hand piece inclined to accommodate the hand's natural grip angle in the wrist's neutral position. A pivot point located at the distal end of the forearm support is concentrically located with the rotational center of the drive actuator. The pivot serves to provide a mounting location for the shoulder strap. The shoulder strap is provided so that the patient can comfortably wear the device while ambulating. The pivot point also serves the role of indicating the proper anatomical alignment of the user's forearm in the device, for proper patient application.

The actuator is electrically operated and is connected to a patient controller. The patient controller allows the patient to turn the device off and on and incorporates a reverse-on-load electronic circuit. The circuit monitors the current through the motor and will reverse the motor's direction if the current exceeds a preset limit. If the patient is in pain and resists the direction the device is traveling the motor current will go up and the circuit will change the device's rotational direction of travel. The controller contains a rechargeable battery and a provision to recharge the battery. The actuator is provided with two mechanically set limit switches to control the amount of rotational motion delivered to the forearm. The device can offer a complete range of motion or be limited to operate between a specific set range of motion as indicated by a goniometer mounted on the drive actuator.

In one aspect of the invention there is provided a continuous passive motion device for a forearm. The device comprises an actuator including a housing and defining a rotational axis. The device includes a proximal arm support member attached to the housing and securing means for securing a user's upper arm and elbow to the proximal arm support member. The device includes a distal forearm support member attached to the actuator for rotational motion about the rotational axis and securing means for securing a user's forearm to the distal forearm support member with the longitudinal anatomical axis of the user's forearm substantially coincident with the rotational axis with the distal forearm support member spaced from the rotational axis so that, during rotation of the distal forearm support member, the user's distal forearm undergoes pronation or supination about the rotational axis.

In this aspect of the invention the proximal arm support member may include an L-shaped stay member with a vertical member and a horizontal member and may include a humeral cuff support affixed to the vertical member for securing the upper arm of the user above the elbow. An elbow cuff support may be affixed to the horizontal member for securing the elbow of the user with the user's arm in substantially 90° flexion.

In this aspect the distal forearm support member may include a forearm stay member pivotally attached to the actuator and rotatable about the rotational axis by the actuator. A distal forearm cuff support may be connected to the forearm stay member adapted to firmly grip the ulna and styloid processes.

In another aspect of the invention there is provided a continuous passive motion device for a forearm comprising a proximal arm support member including a proximal stay member and a distal stay member slidably attached at a first end portion thereof to the proximal stay member and securing means for securing a user's upper arm and elbow to the proximal stay member. The device is provided with an actuator including a housing and defining a rotational axis, the housing being rigidly attached to an opposed end portion of the distal stay member. The device includes a distal forearm support member including a distal forearm stay member attached to the actuator for rotational motion about the rotational axis and distal forearm securing means for connecting a user's forearm to the distal forearm stay member with the longitudinal anatomical axis of the user's forearm substantially coincident with the rotational axis so that, during rotation of the distal forearm stay member, the user's forearm undergoes pronation or supination about the rotational axis.

In this aspect of the invention the distal forearm stay member may include a first stay member connected to the actuator at one end portion thereof and a torque isolating stay member hingedly connected to an opposed end portion of the first stay member. The torque isolating stay member may be pivotable from a closed position adjacent to the rotational axis to an open position radially displaced from the rotational axis.

In this aspect of the invention the distal forearm securing means may include a distal forearm cuff support connected to the torque isolating stay member adapted to firmly grip the distal ulna and styloid processes in the user's forearm.

In another aspect of the invention there is provided a continuous passive motion device for a forearm comprising an proximal arm support member including an L-shaped stay member with a vertical section and a horizontal section and securing means for securing a user's upper arm and elbow to the L-shaped stay member. The device includes an actuator including a housing and defining a rotational axis with the housing being rigidly attached to the vertical section. The device includes a distal forearm support member including a proximal forearm stay member pivotally connected at one end portion thereof to the actuator and slidably connected at an opposed end portion thereof to an end portion of a distal forearm stay member. The proximal forearm stay member and the distal forearm stay member are telescopingly movable for length adjustment. The distal forearm support member includes a distal forearm cuff support connected to the distal forearm stay member adapted to firmly grip the ulna and styloid processes with the longitudinal anatomical axis of the user's forearm substantially collinear with the rotational axis so that, during rotation of the distal forearm stay member, the user's forearm undergoes pronation or supination about the rotational axis.

BRIEF DESCRIPTION OF THE DRAWINGS

The following is a description, by way of example only, of continuous passive motion devices constructed in accordance with the present invention, reference being had to the accompanying drawings, in which.

DETAILED DESCRIPTION OF THE INVENTION

Figure 1:
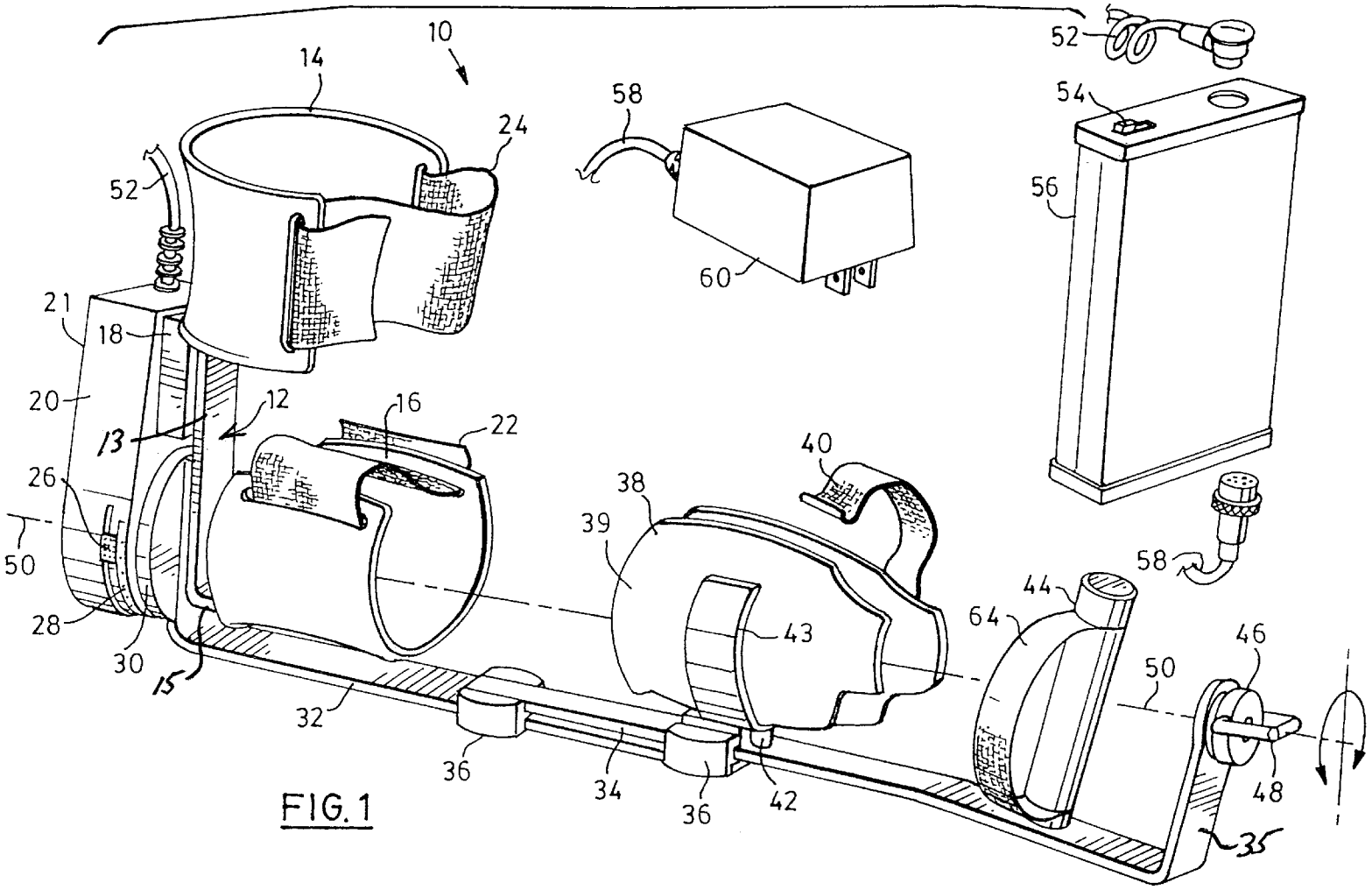
FIG. 1 is a perspective view of a continuous passive motion (CPM) device for exercising constructed in accordance with the present invention.
Figures 2A, 2B, 2C:
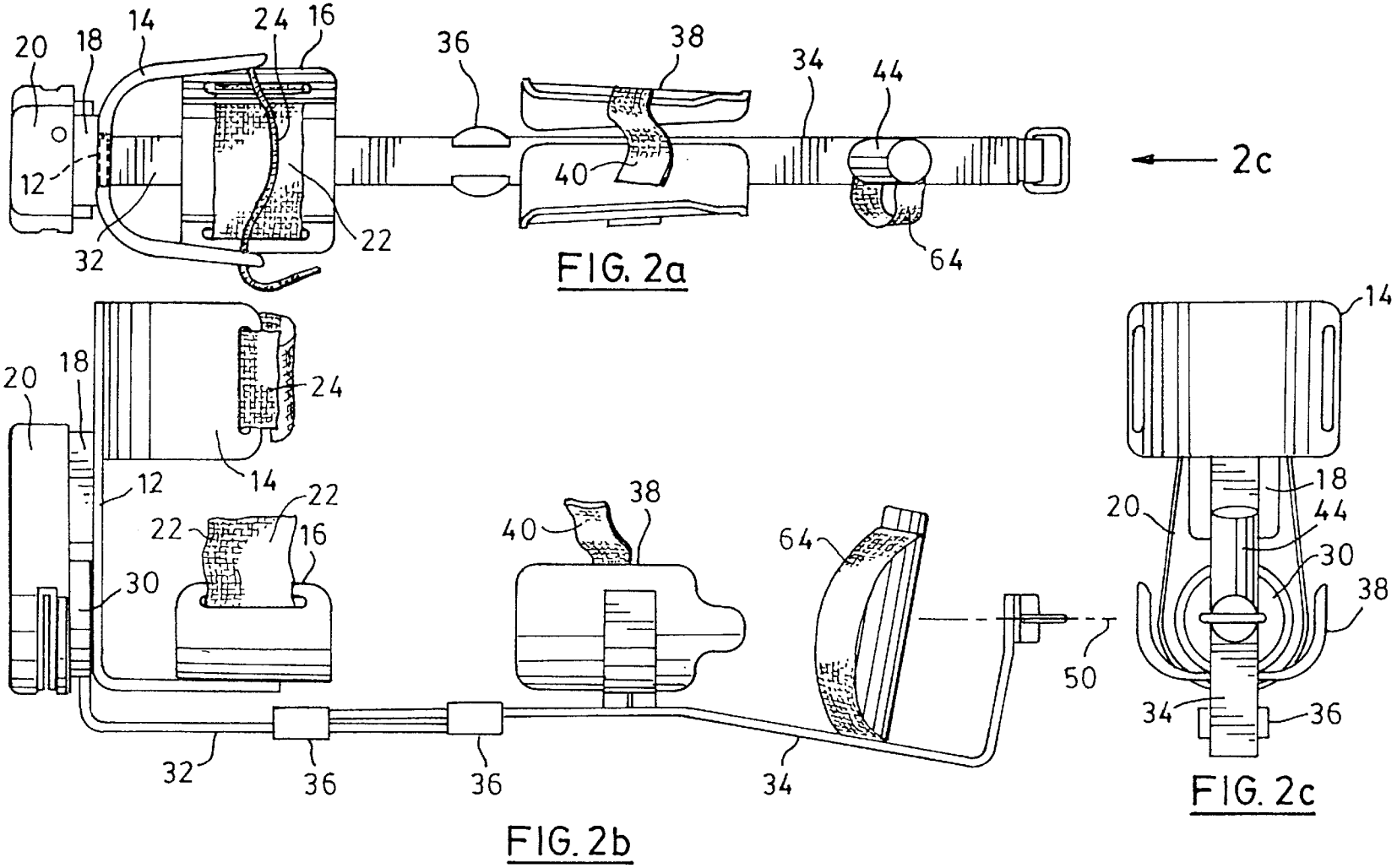
FIG. 2*a* is a orthographical top view of the device of FIG. 1.
FIG. 2*b* is a side view of the device of FIG. 1.
FIG. 2*c* is an end view along arrow 2*c* of FIG. 2*a;*

Referring to FIGS. 1, 2*a* and 2*b,* a continuous passive motion (CPM) device for therapeutic exercising the forearm is shown generally at 10. An actuator 20 contains a motor in housing 21. A rectangular mounting block 18 is rigidly fixed to housing 21 of actuator 20. Two range of motion limit switches 26 are slidably mounted on either side of circular front of drive actuator 20 (only one shown) for adjusting the rotational movement, both clockwise and counter-clockwise, of drive disc 30 mounted to drive actuator 20 to rotate about a rotational axis, to be described in detail hereinafter, and a goniometer 28 is rigidly mounted to drive actuator 20 and indicates the angle through which drive disc 30 rotates. The CPM device 10 includes an L-shaped proximal upper arm support stay 12 rigidly fixed to rectangular mounting block 18 so that upper arm stay 12 remains stationary when actuator 20 is actuated. A humeral cuff support 14 fabricated of flexible material is rigidly fixed to the vertical section 13 of the upper arm stay 12 for securing the upper arm above the elbow of a patient into the device. A proximal forearm cuff support 16 fabricated of a flexible material is rigidly mounted to the horizontal section 15 of upper arm stay 12. Flexible strap 22 on cuff support 16 and strap 24 on cuff support 14 fix respectively the user's upper forearm just below the elbow joint and upper arm above the elbow in the device.

CPM device 10 includes a longitudinal forearm support comprising a proximal support stay 32 which is rigidly fixed to drive disc 30 at one end thereof and two spaced connecting glides 36 fabricated out of a low friction material which are located at the other end portion of stay 32. An L-shaped distal support stay 34 is slidably mounted at one end portion thereof to proximal stay 32 by the two spaced glides. Glides 36 permit stays 32 and 34 to telescope relative to each other to provide an adjustment in length to accommodate anthropometric variances in forearm length between individuals.

A distal forearm cuff support 38 including a rigid bracket 43 with softgoods 39 attached thereto is rigidly fixed to stay 34 through two standoffs 42 (only one shown). A strap 40, made of a flexible material is attached to cuff 38 for securing the arm of the patient into forearm cuff support 38. A hand-piece 44 inclined to accommodate the hand's natural grip angle in the neutral position of the wrist is rigidly mounted to stay 34 to be gripped by the user's hand with a restraining hand strap 64 (see FIGS. 1 and 4) being provided.

Figure 4:
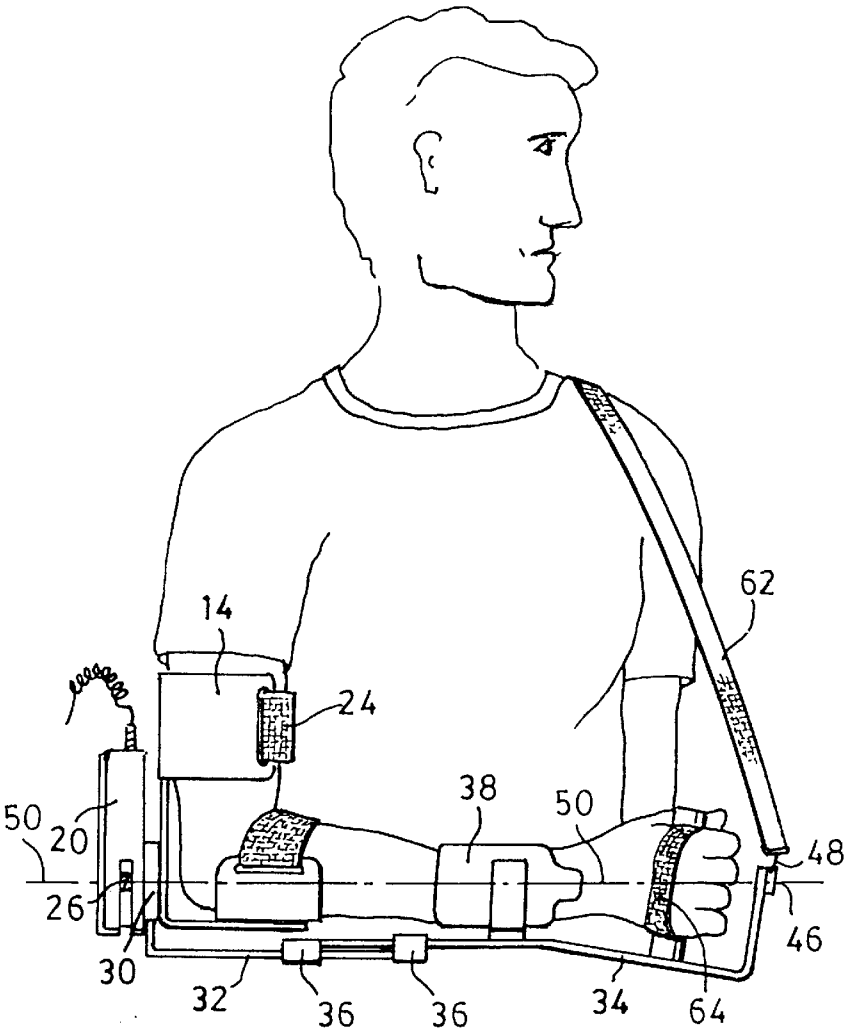
FIG. 4 is an illustration of the CPM device of FIG. 1 showing patient application in the ambulatory mode.

With reference to FIG. 4, an attachment ring 48 is pivotally mounted to a vertically extending end 35 of longitudinal support 34 by a pivot 46 fabricated of a low friction material. Attachment ring 48 rotates about an axis 50 concentric with the rotational axis 50 of drive actuator 20. Pivot 46 and ring 48 provide a mounting location for a shoulder strap 62 so the patient can comfortably wear the device while ambulating. Secondary to a pivotally mounted fixation point the pivot point also indicates the proper anatomical alignment of the forearm in the unit, for proper patient application.

Referring again to FIG. 1, CPM forearm device 10 includes a patient controller 56 electrically connected to actuator 20 by a cord set 52. A switch 54 on controller 56 is a three position switch with one of the positions being ON. Controller 56 is connected to power supply 60 via cable 58 and contains rechargeable batteries so that CPM device 10 may be operated with or without being connected to a wall outlet. Controller 56 may include a belt clip (not shown) to be hooked to the user in the ambulatory mode. Controller 56 is provided with a reverse-on-load electronic circuit. The circuit monitors the current through the motor in the actuator and will reverse the rotational direction of the motor if the current exceeds a preset limit. If the patient is in pain and resists the direction in which the arm supports 32 and 34 are rotating, the motor current will increase and the circuit will reverse the rotational direction of travel of the supports.

More specifically, controller 56 contains control circuitry which includes a three position switch 54, position one corresponding to ON/OFF, position two corresponding to 50% of full load, and position three corresponding to 100% of full load. Controller 56 contains the reverse-on-load technology to monitor the motor current which is disclosed in U.S. Pat. No. 4,716,889 and incorporated herein by reference. The actuator pivoting shaft (not shown) operates within preset values and if a preset value is exceeded, the motor changes direction to move the motor shaft and drive disc 30 in the opposite direction. If a patient resists the motion of the actuator motor shaft, the motor current increases and once the threshold current is exceeded, the unit reverses direction. Actuator 20 has provisions to control the degree of rotational motion delivered to the forearm. Since the rotational motion is controlled by the two mechanically set limit switches 26, the CPM device 10 can offer a complete range of motion or be limited to operate between a specific set range of motion as indicated by the goniometer 28 mounted on the drive actuator 20.

Figure 3A:
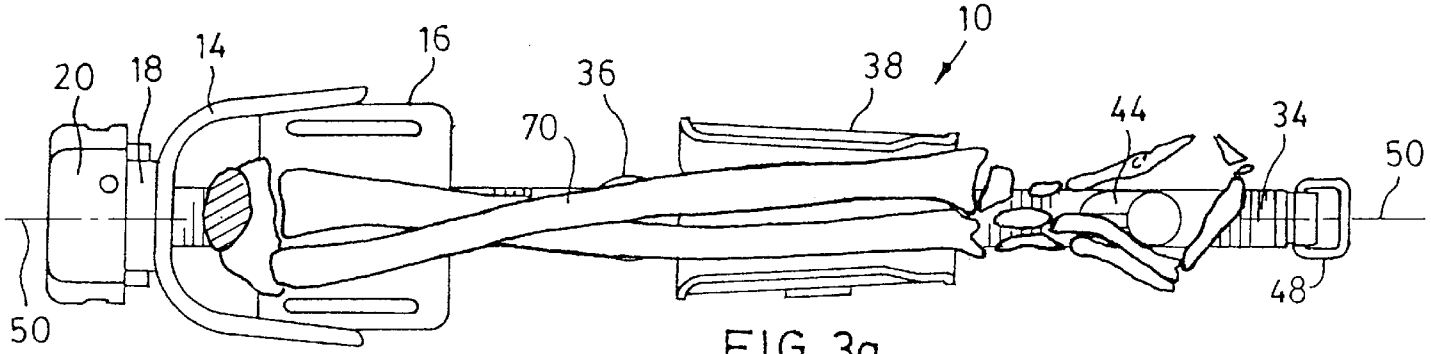
FIG. 3*a* is a orthographical top view of the device of FIG. 1 illustrating the relative position of the humerus, radius, ulnar, carpal, metacarpal and digit skeletal structures of a patient's arm secured into the device.
Figure 3B:
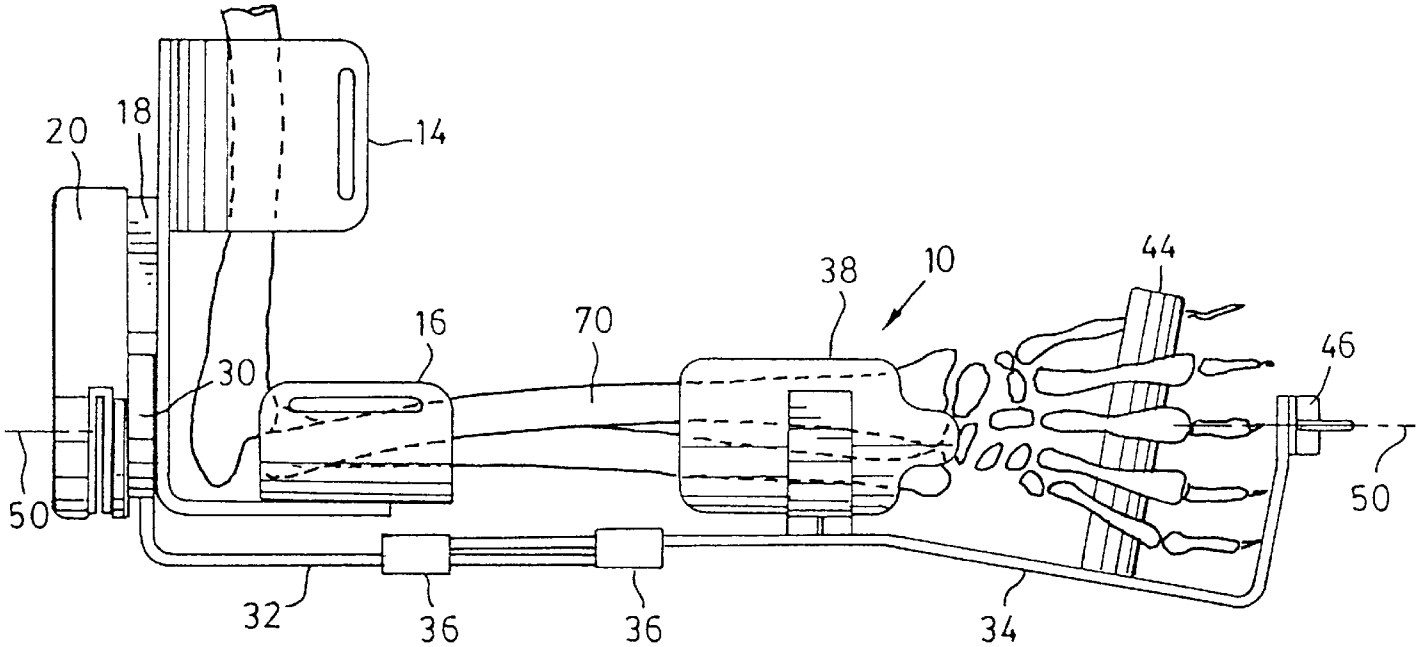
FIG. 3*b* is a side view of the device in FIG. 3*a;*

In operation, the patient secures his or her arm into cuff supports 14, 16 and 38. When the drive disc 30 is rotated by the actuator motor the forearm support stays 32 and 34 are rotated therewith. The upper arm support stay 12 fixes the elbow in substantially 90° of flexion to ensure the rotational motion generated by actuator 20 is transmitted to the user's forearm through stays 32 and 34 and not dissipated at the shoulder of the patient. The rotational motion of pronation and supination is created by aligning the rotational center axis 50 of actuator 20 with the anatomical rotational center of the forearm. With specific reference to FIGS. 3*a* and 3*b*, axis of rotation 50 of actuator 20 corresponds to the anatomical center of the forearm 70 when the forearm is secured in CPM device 10. The rotational centers are concentric (or put another way the longitudinal axis 50 is substantially coincident with the anatomical axis of the user's forearm) to minimize stresses on the affected limb. The relative rotational motion between the upper arm support stay 12 and forearm support (comprising stays 32 and 34) creates the passive anatomical motion of pronation and supination of the forearm.

It will be understood that the upper arm support fixes the elbow in flexion, and preferably in 90° of flexion so that most or all of the rotational motion generated by actuator 20 is transmitted to the forearm and not dissipated at the shoulder of the patient. In addition, 90° of flexion is preferred for patient convenience in, for example, an ambulatory mode. However, it will be understood that the principle of the present invention could be applied with the elbow in the neutral position albeit rotational motion generated by the device for pronation and supination would be transmitted in part to the shoulder.

Figure 5:
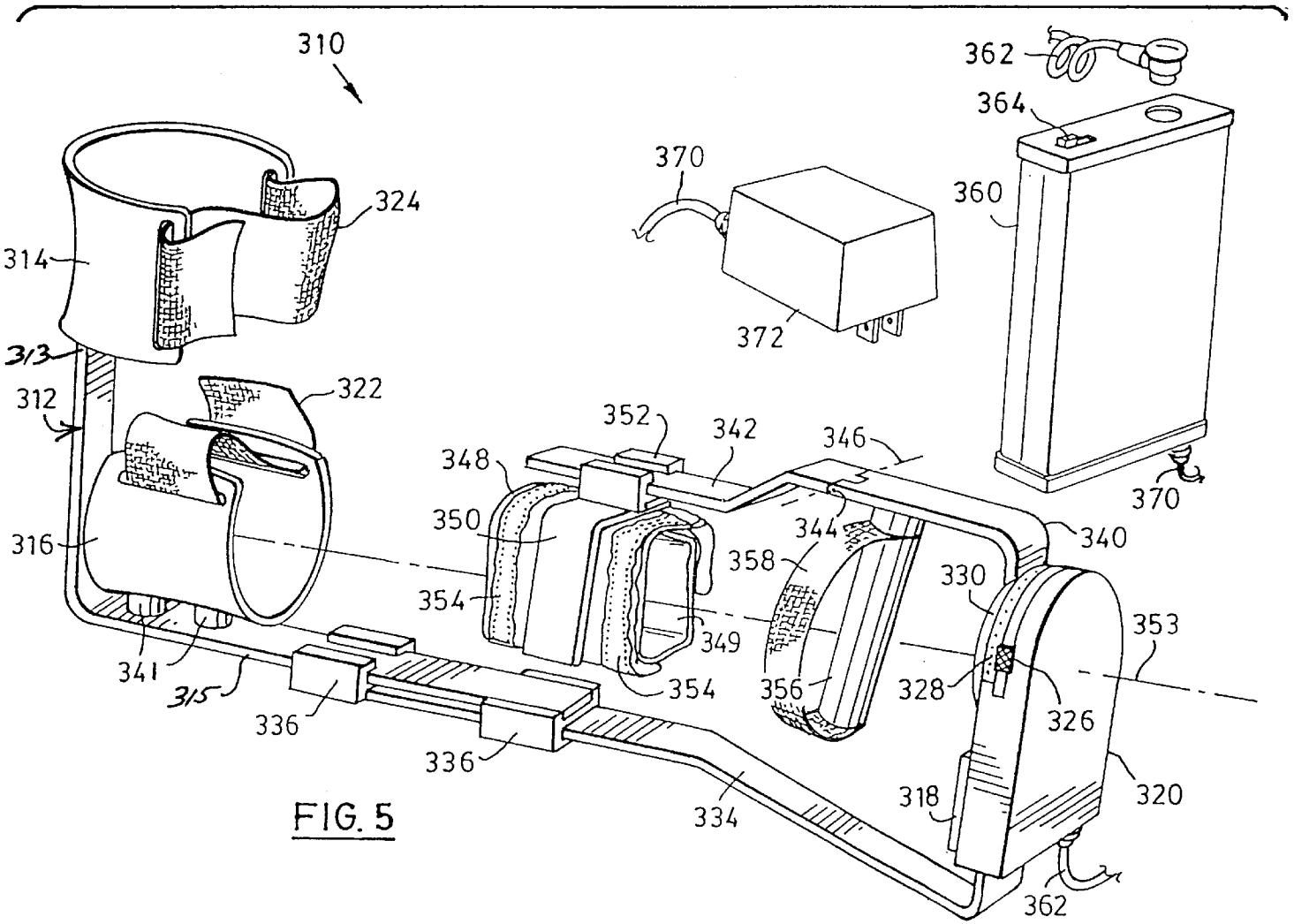
FIG. 5 is a perspective illustration view of an alternate embodiment of a continuous passive motion (CPM) device for exercising, constructed in accordance with the present invention.

Referring to FIG. 5, another embodiment of a continuous passive motion (CPM) device according to the present invention for exercising the forearm is shown generally at 310. The forearm CPM includes an L-shaped humeral or upper arm support stay 312 telescopically mounted to a radial support stay 334 by two glide brackets 336 fabricated from a low friction material to allow the humeral stay 312 and radial stay 334 to telescope relative to each other to provide a length adjustment for the forearm length of the user. The distal end portion of stay 334 is rigidly attached to a rectangular mounting block 318. A drive actuator 320 is rigidly attached to mounting block 318.

A humeral cuff support 314 is fabricated of flexible material and is slidably mounted to the upper vertical portion 313 of humeral stay 312. An elbow cuff support 316 is fabricated of a flexible material and is rigidly mounted to a horizontal component 315 of humeral stay 312 through two standoffs 341. Flexible straps 322 and 324 fix the patient's proximal forearm and upper arm in cuff supports 316 and 314, respectively. Two range of motion limits 326 (only one shown) are slidably mounted to the circular front of drive actuator 320. A goniometer 328 is rigidly mounted to drive actuator 320 and illustrates the angle drive disk 330 rotates through during operation. Drive disk 330 is pivotally mounted to drive actuator 320.

A distal forearm support member comprises a forearm drive stay 340 rigidly fixed to drive disk 330 so that when actuator 320 rotates drive disk 330, stay 340 is rotated. A torque isolating stay 342 is pivotally mounted at 344 about the end portion of forearm drive stay 340 so it pivots about axis 346. The distal forearm support member includes an L-shaped stay 350 pivotally mounted to a glide bracket 352 and glide bracket 352 in turn is slidably mounted to torque isolating stay 342 to allow the position of stay 350 to be adjusted according to the taper of the user's forearm. The distal forearm support member includes two L-shaped distal forearm support cuffs 348 and 349 with cuff 348 being rigidly secured to L-shaped stay 350 with two nuts (not shown). Support cuffs 348 and 349 are fabricated of a hard formable plastic and connected to together by straps 354 which allow the distal forearm of the user to be fixed into cuff supports 348 and 349 with the ulna and styloid processes in contact each with a different inner surface of the two cuffs. The contacting surfaces of cuffs 348 and 349 provide an effective means of applying motion to the forearm. A rigid palmar handle 356 is rigidly mounted to the forearm drive stay 340. Longitudinal axis 353 is the anatomical center of the limb when it is engaged in device 310. The rotational drive axis of actuator 320 is concentric with the anatomical axis of the user's forearm.

Figure 6:
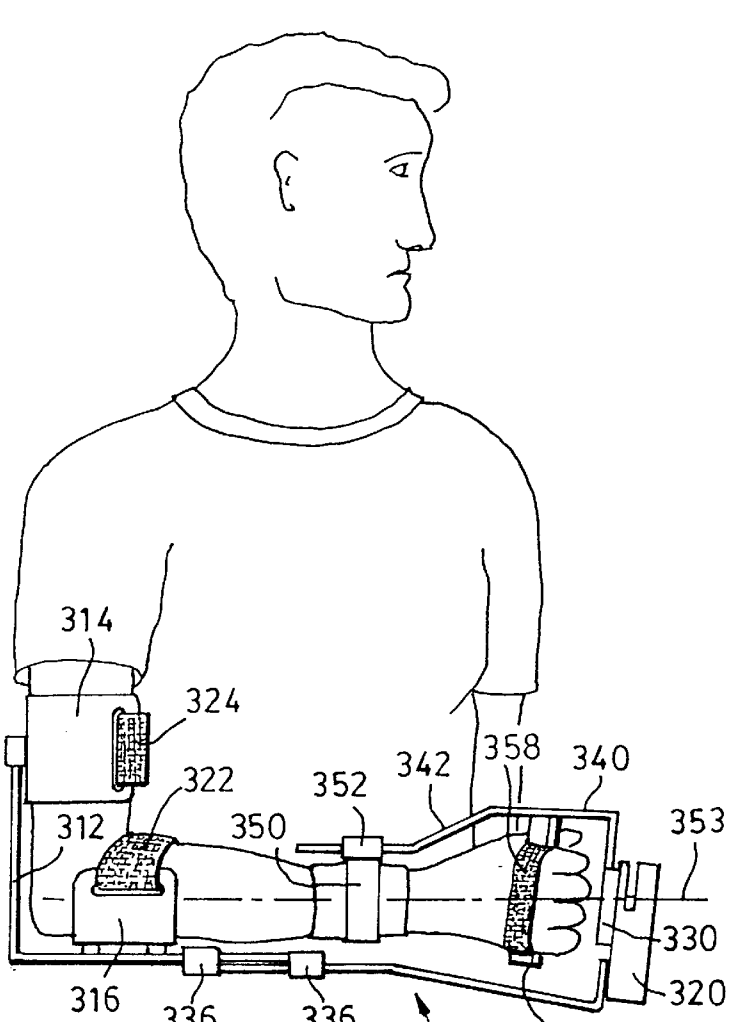
FIG. 6 is an illustration of an alternate embodiment of the forearm CPM device of FIG. 5 showing patient application in the ambulatory mode.

CPM forearm device 310 includes a patient controller 360. CPM device 310 is electrically connected to the patient controller 360 by cord set 362. A switch 364 on patient controller 360 turns the CPM device 310 off and on. Patient controller 360 is connected to power supply 372 via cable 370. Patient controller 360 contains rechargeable batteries and can supply power to actuator 320 with or without being connected to a wall outlet to provide mobility for a patient using the device in an ambulatory fashion, see FIG. 6.

Figure 7:
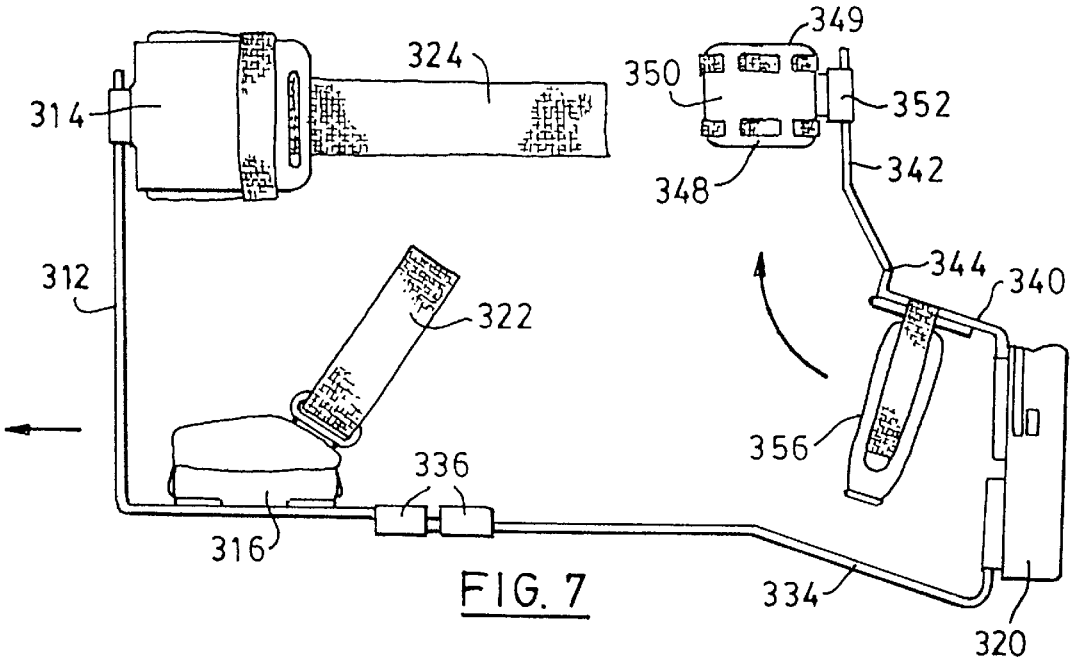
FIG. 7 is an elevation view of the device of FIG. 5 deployed and ready to be fitted to a user.

Referring to FIG. 7, in operation the user fully extends humeral stay 312 in the direction of the arrow and lifts the torque isolating stay 342. The user's arm is then placed into the device with the user gripping hand piece 356 and the elbow in substantially 90° flexion. The humeral stay 312 is then slid forward until the proximal forearm cuff support 316 and humeral cuff support 314 engage the arm whereupon the proximal forearm cuff 316 is secured about the arm. The torque isolating stay 342 is lowered onto the user's forearm. The user inserts his or her distal forearm into distal forearm cuff supports 348 and 349 with the styloid processes of the ulna and radius bearing against the rigid cuff inserts and straps 354 are tightened. The humeral cuff 314 is then slid upwards as high as is comfortable for the user and strap 324 is engaged.

Figure 8:
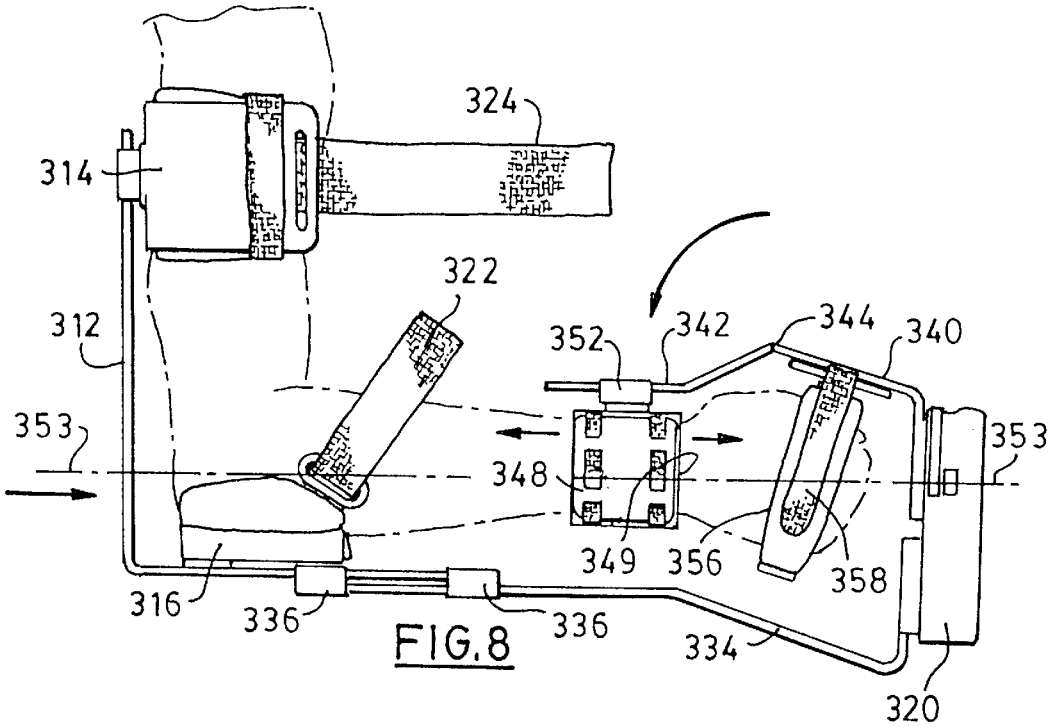
FIG. 8 is a view similar to FIG. 7 showing a user adjusting the device to adjust the fit to the user's arm.

When the user's arm and hand are properly positioned in the CPM device (best seen in FIG. 8) the rotational axis 353 of actuator 320 is concentric with the anatomical rotational axis of the user's forearm. Anthropometric variances in forearm geometry between different users are accommodated by the telescoping stays 312 and 334, the distal forearm supports 348 and 349 being slidable and pivotable along stay 342 and the upper arm cuff support 314 being slidable on stay 312, see FIG. 8.

The preferred means of securing the hand is via the rigid palmar support 356 and a flexible strap 358 (FIG. 5) across the dorsal portion of the user's hand. The flexible strap 358 is suitably fixed to the dorsal portion to ensure the uniform pressure across the metacarpals of the hand.

The present CPM device offers a complete range of motion or may be limited to operate in a specific range of motion set by limit switches 326 as indicated by the goniometer 328. Rotational motion generated at actuator drive disk 330 is transmitted along to the forearm via the forearm drive stay 340 to the torque isolating stay 342 to the forearm support 348 which is suitably fixed to the patient's forearm. The torque isolating stay 342 is pivotally attached to the forearm drive stay 340 and pivots radially from the anatomic axis 353, thereby transmitting torque only to the forearm and minimizing detrimental eccentric loading of the limb. In addition, the forearm support 348 being slidably and pivotally attached to the torque isolating stay 342 advantageously minimizes the axial and radial loading of the forearm. Therefore, the design of the present CPM device advantageously avoids eccentric, axial and radial loading of the limb in the CPM device while providing the desired motion of pronation and supination concentric with the anatomical rotational axis of the forearm.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A continuous passive motion device for a forearm, the forearm having a longitudinal anatomical axis, comprising:

a) an actuator including a housing and a drive means defining a rotational axis, said actuator being connected to a power source for rotating said drive means;

b) a proximal arm support member connected to said housing, and securing means adapted to secure a user's upper arm and elbow to said proximal arm support member; and c) a distal forearm support member attached to said drive means for rotational motion about said rotational axis, and securing means adapted to secure a user's forearm to said distal forearm support member with a longitudinal anatomical axis of a user's forearm substantially coincident with said rotational axis with said distal forearm support member spaced from said rotational axis so that during rotation of said distal forearm support member a user's distal forearm undergoes pronation or supination about the rotational axis.

2. The device according to claim 1 wherein said proximal arm support member includes an L-shaped stay member with a vertical member and a horizontal member, including a humeral cuff support affixed to said vertical member adapted to secure upper arm of the user above the elbow, an elbow cuff support affixed to said horizontal member, adapted to secure the elbow of the user with the user's arm in substantially 90° flexion.

3. The device according to claim 2 wherein said distal forearm support member includes a forearm stay member pivotally attached to said drive means of said actuator and rotatable about said rotational axis by said drive means of said actuator, and an distal forearm cuff support connected to said forearm stay member adapted to firmly grip the ulna and styloid processes.

4. The device according to claim 3 wherein said distal forearm support member includes a rigid palmar support member attached to said distal forearm stay member.

5. The device according to claim 4 wherein said actuator includes a motor for driving said drive means and a controller, and wherein said actuator includes adjustable limit switches for adjusting the rotational motion of said drive means clockwise and counterclockwise about said rotational axis.

6. The device according to claim 5 wherein said controller includes a reverse-on-load electronic circuit for monitoring current load on said motor for reversing the rotational direction of said drive means if the current exceeds a preset limit.

7. The device according to claim 5 wherein said forearm stay member includes a proximal forearm stay member connected at one end portion to said drive means of said actuator and an opposed end portion, connecting means for telescopically connecting said opposed end portion to an end portion of a distal forearm stay member whereby said proximal forearm stay member and said distal forearm stay member can telescope for length adjustment, and wherein said actuator is attached to said vertical member of the L-shaped stay member.

8. The device according to claim 5 wherein said proximal arm support member includes a distal stay member slidably attached at a first end portion thereof to said horizontal member of said L-shaped stay member, said actuator being attached at a second opposed end portion of said distal stay member with said distal forearm stay member adapted to be positioned above the user's forearm.

9. The device according to claim 8 wherein said distal forearm stay member includes a first stay portion connected to said drive means of said actuator at one end portion and a torque isolating stay portion hingedly connected to an opposed end portion of said first stay portion, and wherein said distal forearm cuff support is connected to said torque isolating stay portion and said rigid palmar support member is attached to said first stay portion.

10. A continuous passive motion device for a forearm, the forearm having a longitudinal anatomical axis, comprising:

a) a proximal arm support member including a proximal stay member and a distal stay member slidably attached at a first end portion thereof to said proximal stay member, and securing means, adapted to secure a user's upper arm and elbow to said proximal stay member;

b) an actuator including a housing and drive means defining a rotational axis, said housing being rigidly attached to an opposed end portion of said distal stay member; and c) a distal forearm support member including a distal forearm stay member attached to said drive means of said actuator for rotational motion about said rotational axis and distal forearm securing means adapted to secure a user's forearm to said distal forearm stay member with a longitudinal anatomical axis of a user's forearm being substantially coincident with said rotational axis, wherein during rotation of said distal forearm stay member a user's forearm undergoes pronation or supination about the rotational axis.

11. The device according to claim 10 wherein said distal forearm stay member includes a first stay connected to said drive means at one end portion thereof and a torque isolating stay hingedly connected to an opposed end portion of said first stay, and wherein said torque isolating stay is pivotable from a closed position adjacent to said rotational axis to an open position radially displaced from said rotational axis.

12. The device according to claim 11 wherein said distal forearm securing means includes a distal forearm cuff support connected to said torque isolating stay adapted to firmly grip the distal ulna and radius styloid processes of a user's forearm.

13. The device according to claim 12 wherein said distal forearm securing means includes a distal pivot stay member pivotally mounted on a glide bracket, said glide bracket being slidable on said torque isolating stay, and wherein said distal forearm cuff support is attached to said distal pivot stay member.

14. The device according to claim 12 including a rigid palmar support member attached to said first stay and adapted to be gripped by the user's hand.

15. The device according to claim 11 wherein said proximal stay member includes an L-shaped stay with a vertical section and a horizontal section, said securing means adapted to secure a user's upper arm and elbow to said proximal stay member including a humeral cuff support affixed to said vertical section adapted to secure the upper arm of the user above the elbow and an elbow cuff support affixed to said horizontal section adapted to secure the elbow of the user with the user's arm in substantially 90° flexion.

16. The device according to claim 15 wherein said actuator includes a motor for driving said drive means and a controller, and wherein said actuator includes adjustable limit switches for adjusting the rotational motion of said drive means clockwise and counterclockwise about said rotational axis.

17. The device according to claim 16 wherein said controller includes a reverse-on-load electronic circuit for monitoring current load on said motor for reversing the rotational direction of said drive means if the current exceeds a preset limit.

18. A continuous passive motion device for a forearm, the forearm having a longitudinal anatomical axis, comprising:

a) a proximal arm support member including an L-shaped stay member with a vertical section and a horizontal section and securing means adapted to secure a user's upper arm and elbow to said L-shaped stay member;

b) an actuator including a housing and a drive means defining a rotational axis, said housing being rigidly attached to said vertical section; and c) a distal forearm support member including a proximal forearm stay member drivingly connected at one end portion thereof to said drive means of said actuator and slidably connected at an opposed end portion thereof to an end portion of a distal forearm stay member, and wherein said proximal forearm stay member and said distal forearm stay member are telescopingly movable relative to one another for length adjustment, said distal forearm support member including a distal forearm cuff support connected to said distal forearm stay member adapted to firmly grip the ulna and radius styloid processes with the longitudinal anatomical axis of a user's forearm substantially collinear with said rotational axis so that during rotation of said distal forearm stay member a user's forearm undergoes pronation or supination about the rotational axis.

19. The device according to claim 18 including a rigid palmar support member attached to said distal forearm stay member adapted to be gripped by the user's hand.

20. The device according to claim 19 wherein said securing means adapted to secure a user's upper arm and elbow to said L-shaped stay member includes a humeral cuff support affixed to said vertical section adapted to secure the upper arm of the user above the elbow and an elbow cuff support affixed to horizontal section adapted to secure the elbow of the user with the user's arm in substantially 90° flexion.

21. The device according to claim 19 wherein said actuator includes a motor drivingly connected to said drive means and a user operated controller.

22. The device according to claim 21 wherein said controller includes a reverse-on-load electronic circuit for monitoring current load on said motor for reversing the rotational direction of the drive means if the current exceeds a preset limit.

23. The device according to claim 21 wherein said actuator comprises limit switches for adjusting the rotational motion of said drive means clockwise and counterclockwise about said axis of rotation.

24. A continuous passive motion device for a forearm, the forearm having a longitudinal anatomical axis, comprising:

a) an actuator including a housing and a drive means defining a rotational axis;

b) a proximal arm support member connected to said housing, and securing means adapted to secure a user's upper arm and elbow to said proximal arm support member; and c) a distal forearm support member attached to said drive means for rotational motion about said rotational axis, and means adapted to be gripped by a user's hand mounted to said distal forearm support member so that a longitudinal anatomical axis of a user's forearm is substantially coincident with said rotational axis with said distal forearm support member spaced from said rotational axis so that during rotation of said distal forearm support member a user's distal forearm undergoes pronation or supination about the rotational axis.

* * * * *